US007922631B2

(12) United States Patent
Ish, III

(10) Patent No.: US 7,922,631 B2
(45) Date of Patent: Apr. 12, 2011

(54) APPARATUS AND METHODS FOR ADJUSTABLE SUPPORTS FOR EXERCISE MACHINES

(75) Inventor: A. Buell Ish, III, Redmond, WA (US)

(73) Assignee: Vectra Fitness, Inc., Redmond, WA (US)

( * ) Notice: Subject to any disclaimer, the term of this patent is extended or adjusted under 35 U.S.C. 154(b) by 788 days.

(21) Appl. No.: 10/913,137

(22) Filed: Aug. 5, 2004

(65) Prior Publication Data

US 2006/0030462 A1 Feb. 9, 2006

(51) Int. Cl.
*A63B 21/062* (2006.01)

(52) U.S. Cl. ..... 482/103

(58) Field of Classification Search ..... 482/1, 4, 482/93, 94, 98, 99, 102, 103, 138, 908, 92, 482/97, 100–101; *A63B 21/062*
See application file for complete search history.

(56) References Cited

U.S. PATENT DOCUMENTS

| | | | | |
|---|---|---|---|---|
| 3,877,421 | A * | 4/1975 | Brown | 601/23 |
| 4,573,678 | A * | 3/1986 | Lamb et al. | 482/80 |
| 4,728,101 | A | 3/1988 | King | |
| 4,793,608 | A | 12/1988 | Mahnke et al. | |
| 4,804,179 | A * | 2/1989 | Murphy | 482/97 |
| 4,875,676 | A | 10/1989 | Zimmer | |
| 5,356,360 | A | 10/1994 | Johns | |
| 5,417,631 | A * | 5/1995 | Brown et al. | 482/92 |
| 5,417,634 | A | 5/1995 | Habing | |
| 5,472,397 | A | 12/1995 | Ammoscato et al. | |
| 5,549,533 | A | 8/1996 | Olson et al. | |
| 5,597,375 | A | 1/1997 | Simonson | |
| 5,605,524 | A * | 2/1997 | Husted | 482/112 |
| 5,672,143 | A | 9/1997 | Ish, III | |
| 5,695,433 | A * | 12/1997 | Buisman | 482/70 |
| 5,779,601 | A | 7/1998 | Ish, III | |
| 5,823,921 | A | 10/1998 | Dawson | |
| 6,174,270 | B1 * | 1/2001 | Dagenais | 482/148 |
| 6,447,430 | B1 | 9/2002 | Webb et al. | |
| 6,582,346 | B1 * | 6/2003 | Lines et al. | 482/102 |
| 6,746,378 | B2 | 6/2004 | Morris et al. | |
| 7,223,186 | B2 * | 5/2007 | Tresvant | 473/447 |

OTHER PUBLICATIONS www.dictionary.com, Sep. 16, 2009, definitions for "through" and "couple".*

* cited by examiner

*Primary Examiner* — Loan Thanh
*Assistant Examiner* — Oren Ginsberg

(57) ABSTRACT

Adjustable supports for exercise machines are disclosed. In one embodiment, an exercise machine includes a load, a force-transferring assembly operatively coupled to the load, a support frame operatively coupled to the force-transferring assembly, and an exercise station coupled to the force-transferring assembly proximate a support member of the support frame. The support member is operatively coupled to an upright member of the support frame by an adjustment assembly. The adjustment assembly is adjustable to enable the support member to project from the upright member at a plurality of support positions such that the exercise station is correspondingly adjustable over a plurality of vertical positions. In some embodiments, the support member is pivotable relative to the upright member. Alternately, slideable members may allow the support member to be selectively retracted and extended to provide the desired vertical position adjustment.

17 Claims, 7 Drawing Sheets

APPARATUS AND METHODS FOR ADJUSTABLE SUPPORTS FOR EXERCISE MACHINES

FIELD OF THE INVENTION

This invention relates to apparatus and methods for adjustable supports for exercise machines.

BACKGROUND OF THE INVENTION

Weight training machines are highly popular with people interested in exercising to maintain their health and appearance. Conventional weight training machines typically include a weight stack that provides a variable load, and one or more exercise stations coupled to the weight stack that enable a person to exercise different portions of their body. One of the exercise stations is typically a high pull (or lat) station that is situated relatively high on the exercise machine, and that enables a user to perform a variety of different exercises, including exercises that shape and tone the muscles of the upper body.

For example, FIG. 1 is an isometric view of an exercise machine 100 that includes a high pull station 114 in accordance with the prior art. The high pull station 114 is positioned at the end of a support member 120 that extends outwardly from an upright support 118 of a support frame 109. A pull bar 115 is coupled to a cable 117 that is engaged over a pulley 119 attached to the end of the support member 120. In turn, the cable 117 is operatively coupled to a weight stack 105 partially enclosed within a shroud 112. A user may select a desired training weight, and then exert a training force on the pull bar 115 to perform the desired exercises.

In the example shown in FIG. 1, the exercise machine 100 also includes a press station 102 having a press arm 106 pivotally coupled to a first upright member 108 of the support frame 109. The press arm 106 includes a laterally-extending member 110 that is operatively coupled by a cable-and-pulley assembly (not shown) to a weight stack 105 partially enclosed within a shroud 112. The exercise machine 100 further includes a butterfly station 116 that is also operatively coupled to the weight stack 105. Exercise machines of the type shown in FIG. 1 are described more fully, for example, in U.S. Pat. No. 5,779,601 issued to Ish, which patent is incorporated herein by reference.

Although desirable results have been achieved using prior art exercise machines of the type shown in FIG. 1, there is room for improvement. For example, in the above-described apparatus, users of different sizes may have different levels of satisfaction when using the high pull station 114. Relatively smaller users may not be able to reach the pull bar 115, or may only reach the pull bar 115 with difficulty, while relatively taller users may reach the pull bar 115 easily but may find that the effective range of pull of the high pull station 114 does not fully satisfy their training needs. Novel apparatus and methods that mitigate these characteristics of prior art exercise machines would be useful.

SUMMARY OF THE INVENTION

The present invention is directed to apparatus and methods for adjustable supports for exercise machines. Embodiments of apparatus and methods in accordance with the present invention may advantageously improve the versatility and usefulness of exercise machines, and therefore user satisfaction, in comparison with conventional exercise machines.

In one embodiment, an exercise machine includes a load, a force-transferring assembly operatively coupled to the load, a support frame operatively coupled to the force-transferring assembly, and an exercise station coupled to the force-transferring assembly proximate a support member of the support frame. The support member is operatively coupled to an upright member of the support frame by an adjustment assembly. The adjustment assembly is adjustable to enable the support member to project from the upright member at a plurality of support positions such that the exercise station is correspondingly adjustable over a plurality of vertical positions. In some embodiments, the support member is pivotable relative to the upright member. In other embodiments, slideable members allow the support member to be selectively retracted and extended to provide the desired adjustability of the vertical position of the exercise station.

BRIEF DESCRIPTION OF THE DRAWINGS

Preferred and alternative embodiments of the present invention are described in detail below with reference to the following drawings.

DETAILED DESCRIPTION

The present invention relates to apparatus and methods for adjustable supports for exercise machines. Many specific details of certain embodiments of the invention are set forth in the following description and in FIGS. 2-13 to provide a thorough understanding of such embodiments. One skilled in the art will understand, however, that the present invention may have additional embodiments, or that the present invention may be practiced without several of the details described in the following description.

In general, embodiments of apparatus and methods in accordance with the present invention may advantageously provide an adjustable support for a high pull station of an exercise machine that provides improved control over the vertical position of the high pull station in comparison with prior art exercise machines. Because the vertical position of the high pull station is adjustable, the high pull station may be better suited for users of different sizes, thereby increasing the users' satisfaction with the exercise machine. Furthermore, the variability of the vertical position of the high pull station may allow the exercise machine to be situated in environments having a relatively lower ceiling in comparison with prior art machines, thereby improving the versatility of the apparatus.

Figure 1:
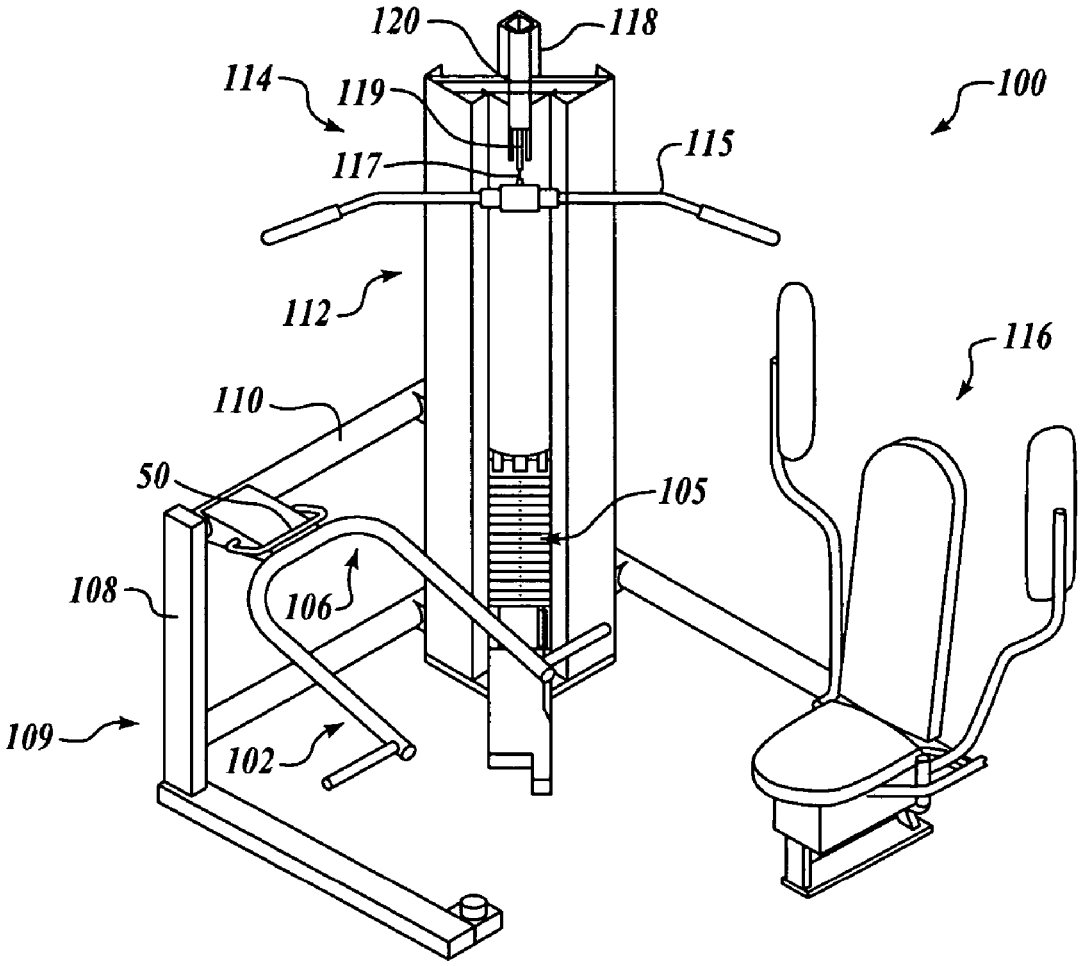
FIG.1 (PRIOR ART)
FIG. 1 is an isometric view of an exercise machine that includes a high pull station in accordance with the prior art.
Figure 2:
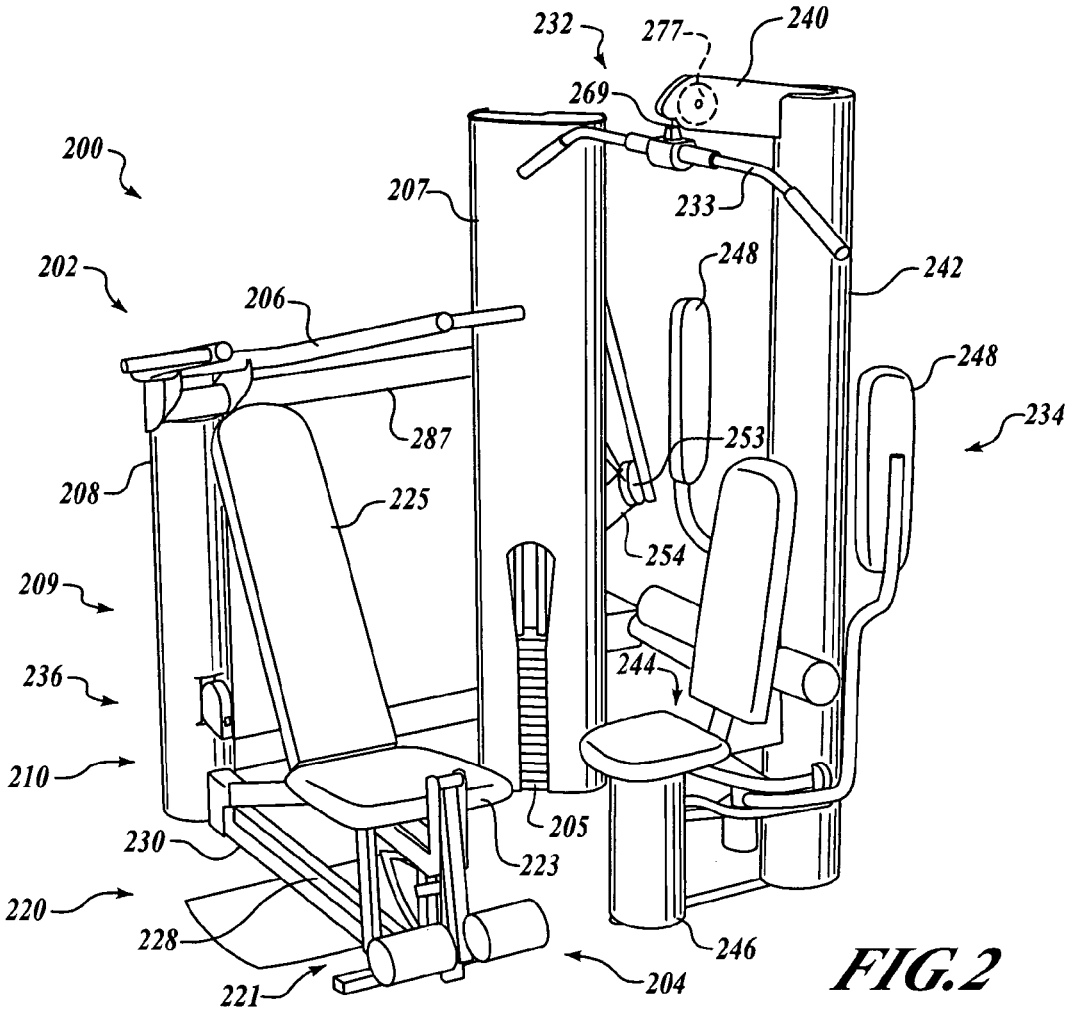
FIG. 2 is an isometric view of an exercise machine having a high pull station in accordance with an embodiment of the present invention.

FIG. 2 is an isometric view of an exercise machine having a high pull station 232 in accordance with an embodiment of the present invention. The high pull station 232 is positioned at the end of an adjustable support 240 that extends outwardly from an upright member 242 of a support frame 209. As described more fully below, the position of the adjustable support 240 may be adjusted by a user to raise or lower the position of the high pull station 232 as desired.

The high pull station 232 includes a pull bar 233 that is coupled to a cable 269 this is engaged onto a pulley 277 attached to the adjustable support 240. In turn, the cable 269 is operatively coupled by a other components of a force-transferring assembly, in this embodiment a cable-and-pulley assembly 250 (FIG. 7), to a weight stack 205 partially enclosed within a shroud 207. To perform an exercise, the user may select a desired training load on the weight stack 205, and then exert a training force on the pull bar 233.

Figure 3:
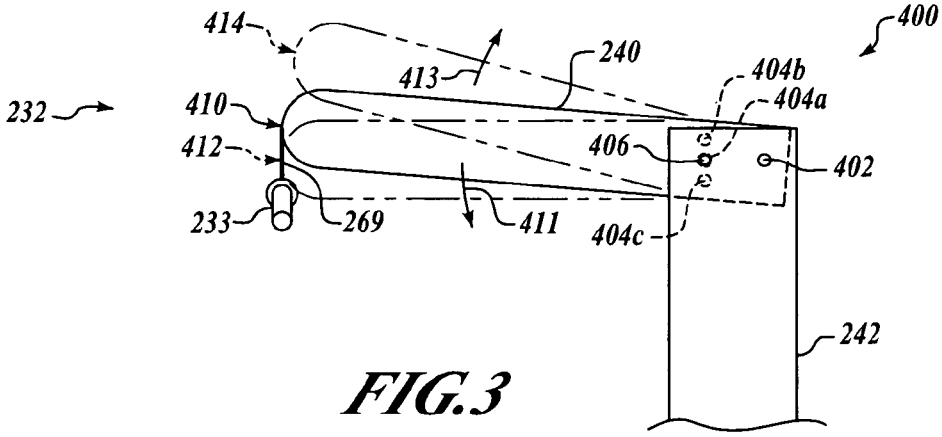
FIG. 3 is a side elevational view of the high pull station of the exercise machine of FIG. 2.

FIG. 3 is a side elevational view of the high pull station 232 of the exercise machine 200 of FIG. 2. In this embodiment, the adjustable support 240 is coupled to the upright member 242 of the support frame 209 by an adjustment assembly 400. The adjustment assembly 400 includes a pivot member 402 that pivotably couples the adjustable support 240 to the upright member 242. In one particular embodiment, for example, the pivot member 402 is a bolt that is engaged through portions of the upright member 242 and through a pivot hole in the adjustable support 240. The adjustment assembly 400 further includes a plurality of adjustment apertures 404 disposed through the adjustable support 240.

A locking member 406 is disposed through a first adjustment aperture 404*a* and through corresponding portions of the upright member 242, thereby securing the adjustable support 240 in a first position 410. Alternately, the adjustable support 240 may be rotated in a downward direction 411 so that the locking member 406 may be disposed through a second adjustment aperture 404*b* to secure the adjustable support 240 in a second position 412, or may be rotated in an upward direction 413 so that the locking member 406 may be disposed through a third adjustment aperture 404*c* to secure the adjustable support 240 in a third position 414.

Embodiments of apparatus and methods in accordance with the present invention may provide significant advantages over the prior art. Because the position of the adjustable support 240 may be adjusted via the adjustment assembly 400, the high pull station 232 may be moved into the first, second or third positions 410, 412, 414 to accommodate users of varying sizes and preferences. Furthermore, because the adjustable support 240 may be lowered into the second position 412, the exercise machine 200 may be located in a room having a relatively lower ceiling. Thus, exercise machines in accordance with the present invention may be more versatile and useful than conventional exercise machines, and may improve user satisfaction.

It will be appreciated that a variety of different embodiments in accordance with the present invention may be conceived, and that the invention is not limited to the particular embodiment described above and shown in FIG. 3. For example, a greater or fewer number of adjustment apertures 404 may be provided through the adjustable support 240 to provide a greater or fewer number of adjustable support positions. Also, additional pivot holes may be provided through the adjustable support for the pivot member 402 to provide additional positional adjustability of the adjustable support. Furthermore, the positions of the pivot hole(s) and the adjustment apertures may be adjusted (e.g. reversed) so that the pivot member is closer to the high pull station 232 than the locking member 406.

Figure 4:
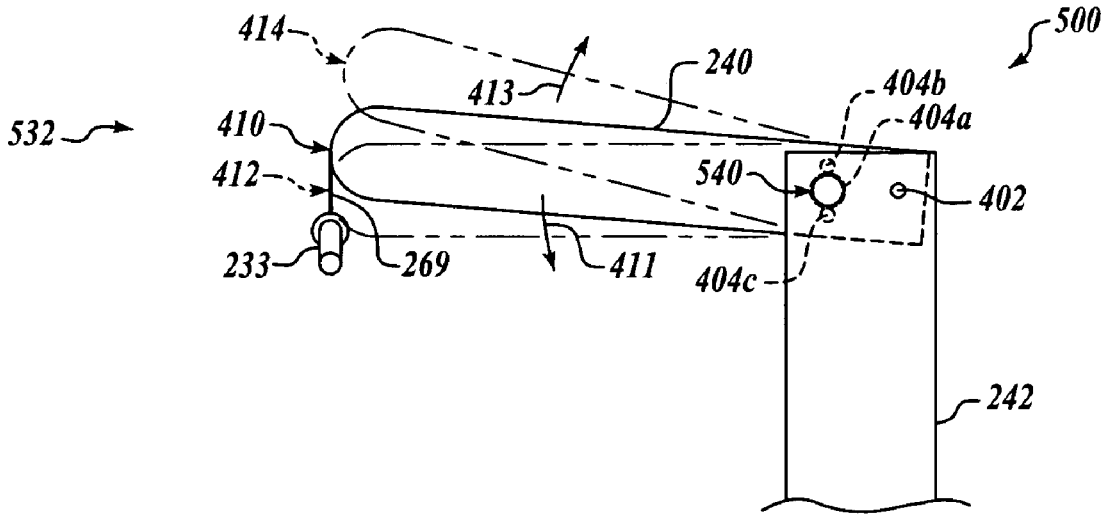
FIG. 4 is a side elevational view of a high pull station in accordance with an alternate embodiment of the invention.
Figure 5:
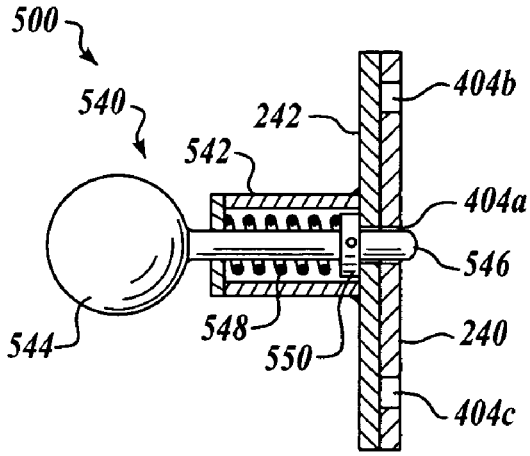
FIG. 5 is an enlarged, side cross-sectional view of a locking assembly of the high pull station of FIG. 4.

FIG. 4 is a side elevational view of a high pull station 532 in accordance with an alternate embodiment of the invention. In this embodiment, the adjustable support 240 is coupled to the upright member 242 by an adjustment assembly 500 that includes a locking assembly 540. FIG. 5 is an enlarged, side cross-sectional view of the locking assembly 540 of FIG. 4. The locking assembly 540 includes a housing 542 coupled to the upright member 242. An elongated locking member 546 is disposed through the housing 542 and has a knob 544 coupled thereto. A biasing spring 548 is disposed within the housing 542 and exerts a biasing force on a flange 550 of the locking member 546.

In operation, a user may pull outwardly on the knob 544 to compress the spring 548 and disengage the locking member 546 from the adjustment apertures 404. The adjustable support 240 may then be moved into one of the available positions 410, 412, 414. The user may then release the knob 544, allowing the spring 548 to engage the locking member 546 into the corresponding adjustment aperture 404, thereby securing the adjustable support 240 in the selected position. Thus, the adjustment assembly 500 advantageously provides the user with an easily accessible, easily operable means of adjusting the position of the adjustable support 240.

Figure 6:
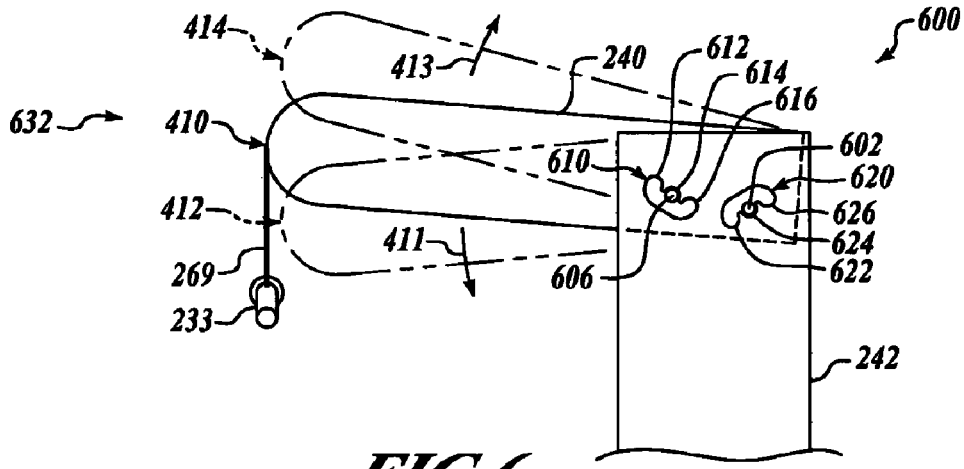
FIG. 6 is a side elevational view of a high pull station in accordance with another embodiment of the invention.

FIG. 6 is a side elevational view of a high pull station 632 in accordance with another embodiment of the invention. In this embodiment, the high pull station 632 includes an adjustment assembly 600 having first and second adjustment slots 610, 620 disposed in the adjustable support 240. A locking member 606 is disposed through the first adjustment slot 610, and a pivot member 602 is disposed through the second adjustment slot 620. The locking member 606 and the pivot member 602 may be fixed relative to the upright member 242, while the first and second adjustment slots 610, 620 are disposed in the adjustable support 240 and are moveable relative to the upright member 242. The first adjustment slot 610 includes a first locking portion 612, a second locking portion 614, and a third locking portion 616, while the second adjustment slot 620 includes a first pivot portion 622, a second pivot portion 624, and a third pivot portion 626.

In operation, the first and second adjustment slots 610 are oriented such that with the locking member 606 positioned in the second locking portion 614 and the pivot member 602 positioned in the second pivot portion 624, the adjustable arm 240 is positioned in the first position 410. The adjustable arm 240 may then be adjusted such that the locking member 606 is positioned in the first locking portion 612 and the pivot member 602 is positioned in the first pivot portion 622, thereby swinging the adjustable support 240 in the downward direction 411 into the second position 412. Also, the adjustable arm 240 may be adjusted such that the locking member 606 is positioned in the third locking portion 616 and the pivot member 602 is positioned in the third pivot portion 626, thereby swinging the adjustable support 240 in the upward direction 413 into the third position 414. Thus, the adjustment assembly 600 advantageously provides the user with an easily accessible, easily operable means of adjusting the position of the adjustable support 240.

Figure 11:
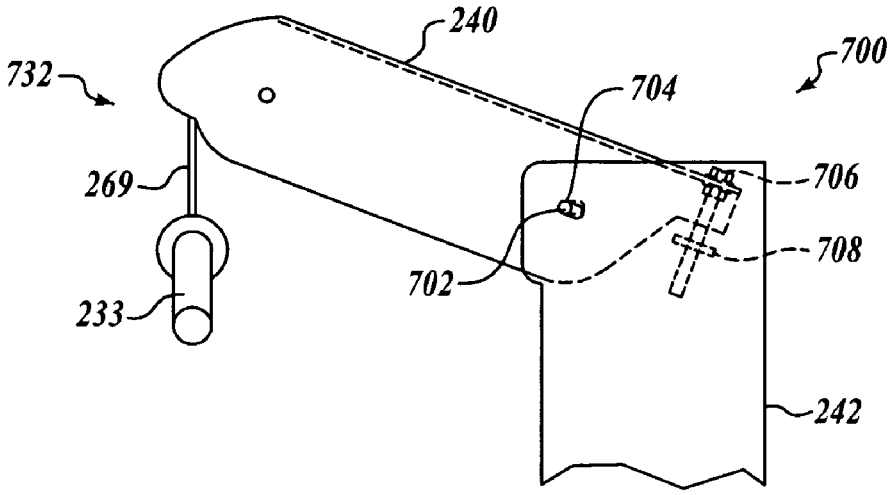
FIGS. 11 through 13 are side elevational views of high pull stations in accordance with additional embodiments of the invention.

FIG. 11 is a side elevational view of a high pull station 732 in accordance with another embodiment of the invention. In this embodiment, the adjustable support 240 is coupled to the upright member 242 by an adjustment assembly 700 that includes a pivot member 702 disposed through a pivot aperture 704 in the adjustable support 240. The pivot member 702 pivotably couples the adjustable support 240 to the upright member 242. The adjustment assembly 700 further includes a threaded member 706 engaged through portions of the adjustable support 240 and the upright member 242. A threaded bracket 708 is threadedly engaged onto the threaded member 706. In operation, the desired adjustability of the adjustable support 240 is achieved by turning the threaded member 706 in a first direction to raise the high pull station 732, and in a second direction to lower the high pull station 732. Thus, the above-noted advantages of apparatus and methods in accordance with the invention may be achieved using a relatively simple, robust and economical adjustment assembly.

Figure 12:
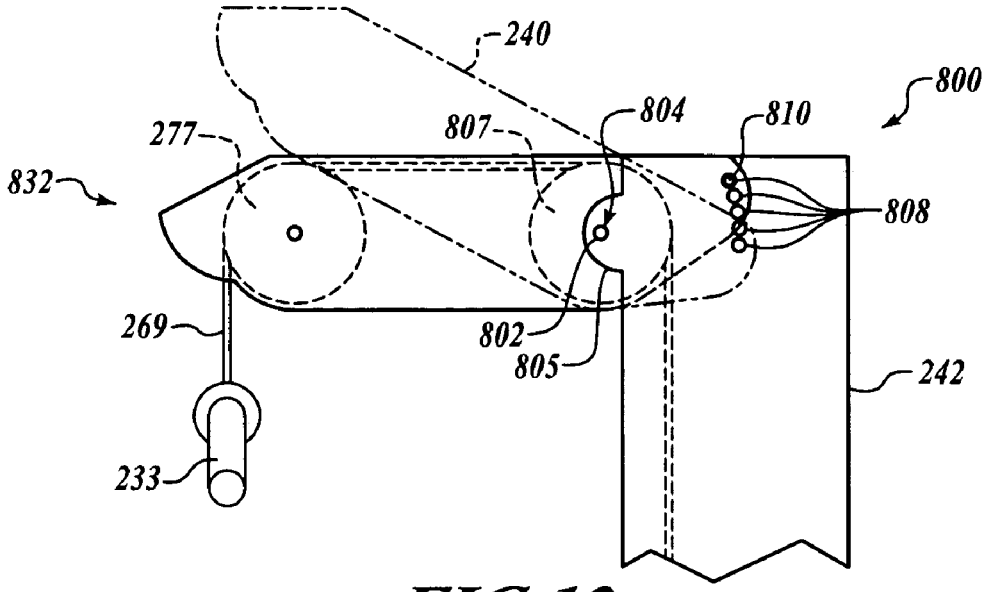

FIG. 12 is a side elevational view of a high pull station 832 in accordance with another alternate embodiment of the invention. In this embodiment, the adjustable support 240 is coupled to the upright member 242 by an adjustment assembly 800 that includes a pivot member 802 disposed through a pivot aperture 804 in the adjustable support 240. The pivot member 802 is also disposed through a pair of pivot tabs 805 that extend outwardly from the upright member 242 on opposing sides of the adjustable support 240. The pivot member 802 may be centered through a pivot wheel 807 disposed within the adjustable support 240. A plurality of adjustment apertures 808 are disposed through the adjustable support 240 opposite the pivot member 802 from the pulley 277, and a locking member 810 is disposed through a portion of the upright member 242 and one of the adjustment apertures 808. In operation, the position of the adjustable support 240 is adjusted by removing the locking member 810, pivoting the adjustable support 240 into the desired position, and then re-inserting the locking member 810 through a different adjustment aperture 808.

Figure 13:
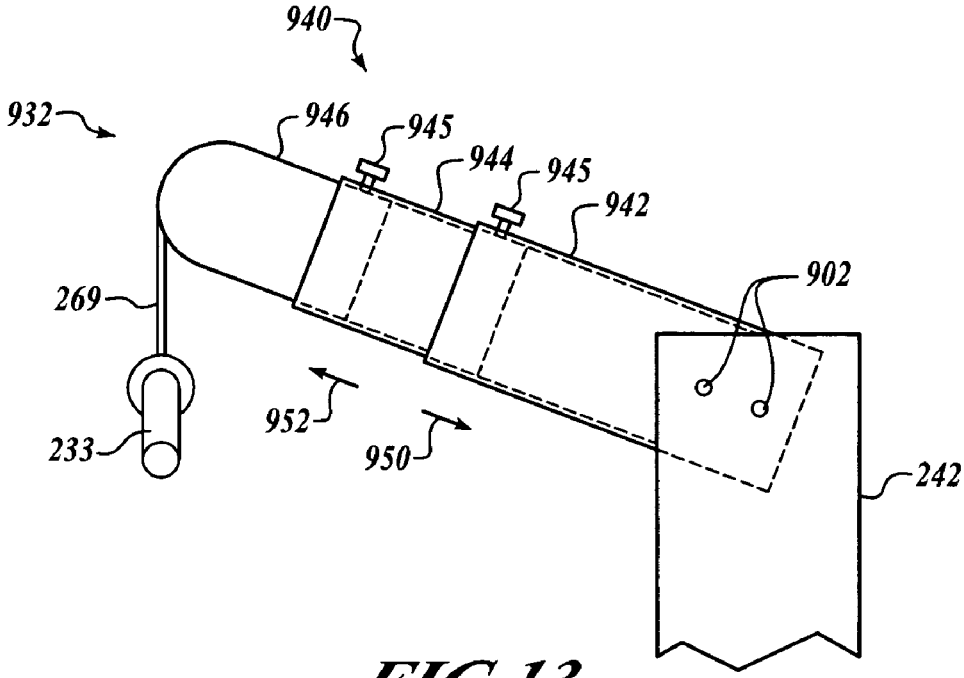

FIG. 13 is a side elevational view of a high pull station 932 in accordance with yet another embodiment of the invention. In this embodiment, an adjustable support 940 includes first, second, and third members 942, 944, 946. The first member 942 is coupled to the upright member 242 by a pair of coupling members 902. The second member 944 is slideably engaged into the first member 942, and the third member 946 is slideably engaged into the second member 944.

In operation, the desired adjustability of the adjustable support 940 is achieved by sliding one or more of the second and third members 944, 946 in a retraction or extension direction 950, 952. More specifically, the third member 946 may be slideably engaged in the retraction direction 950 into the second member 944, and the second member 944 may be slideably engaged in the retraction direction 950 into the first member 942, thereby shortening the support member 940 and reducing the vertical height of the pull bar 233. Conversely, the second member 944 may be slideably withdrawn in the extension direction 952 from the first member 942, and the third member 946 may be slideably withdrawn in the extension direction 952 from the second member 942, thereby lengthening the support member 940 and increasing the vertical height of the pull bar 233. Locking members 945 (e.g. threaded members) may be added to selectively secure the members 944, 946 in the desired positions. Thus, the above-noted advantages of apparatus and methods in accordance with the invention may be achieved using a non-pivoting adjustable support having a plurality of slideable portions that enable the height of the exercise station to be adjusted as desired.

It will be appreciated that in alternate embodiments, the various members 942, 944, 946 may be slideably engaged differently than the particular embodiment shown in FIG. 13, and that the invention is not limited to the particular embodiment show therein. For example, in alternate embodiments, the first member 942 may slideably engage into the second member 944, and the second member 944 may slideably engage into the third member 946. In further embodiments, the adjustable support may include a greater or fewer number of slideably engaged members than the embodiment shown in FIG. 13.

The remaining components of the exercise machine 200 shown in FIG. 2 will now be described. As shown in FIG. 2, the exercise machine 200 further includes a press arm station 202, a leg station 204, a butterfly station 234, and a low pulley station 236. The butterfly station 234 includes a seat 244 positioned atop a third upright member 246 of the support frame 209, and a pair of moveable swing arms 248 operatively coupled to the support frame 209 and positioned proximate the seat 244. Thus, while seated on the seat 244, a user may perform exercises using the high pull station 232 and the butterfly station 234. The low pulley station 236 is positioned near a lower end of the first upright member 208, and is typically used by standing proximate the first upright member 208.

Figure 7:
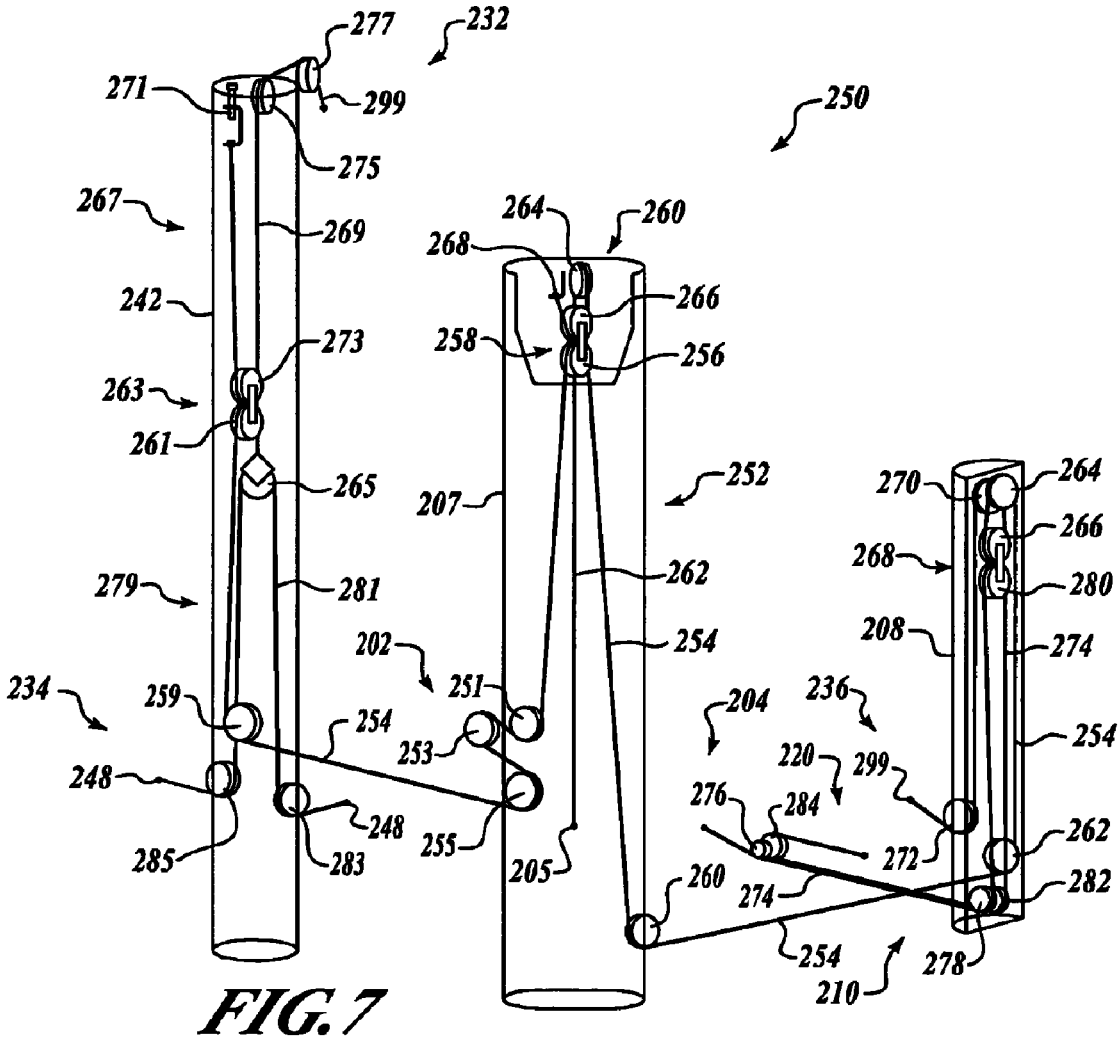
FIG. 7 is a schematic view of a cable-and-pulley assembly of the exercise machine of FIG. 2.

FIG. 7 is a schematic view of a cable-and-pulley assembly 250 (or more generally a force-transferring assembly) of the exercise machine 200 of FIG. 2. In this embodiment, the cable-and-pulley assembly 250 includes a plurality of subassemblies that couple the various exercise stations to the weight stack 205. Except for certain inventive aspects of the cable-and-pulley assembly 250, the tensioning and cooperation of the one or more cable-and-pulley subassemblies is generally known and is described more fully, for example, in the above-referenced U.S. Pat. No. 5,779,601 issued to Ish, and in U.S. Pat. No. RE 34,572 issued to Johnson et al., which patent is incorporated herein by reference.

As shown in FIG. 7, in this embodiment, the cable-and-pulley assembly 250 includes a first cable-and-pulley subassembly 260 having a first cable 262 coupled to the weight stack 205 and extending upwardly through the shroud 207. The first cable 262 is engaged onto a first guide pulley 264 and an upper pulley 266 of a first double floating pulley 258. The first cable 262 terminates at a first anchor point 268 proximate an upper end of the shroud 207.

A second cable-and-pulley subassembly 252 includes a second cable 254 that is engaged onto a lower pulley 256 of the first double floating pulley 258 within the shroud 207. The second cable 254 is further engaged onto a second guide pulley 260 proximate a lower portion of the shroud 207, a third guide pulley 262 proximate a lower end of the first upright member 208, and a fourth guide pulley 264 proximate an upper end of the first upright member 208. The second cable 254 then engages onto an upper pulley 266 of a second double floating pulley 268, and onto fifth and sixth guide pulleys 270, 272 before terminating at the low pulley station 236. In this embodiment, a stop 299 is coupled to the second cable 254 proximate the low pulley station 236.

The second cable 254 also extends from the first double floating pulley 258 within the shroud 207 to seventh, eighth, and ninth pulleys 251, 253, 255 operatively associated with the press station 202. The second cable 254 then engages onto a tenth guide pulley 259 proximate a lower portion of the second upright member 242, and engages onto a lower pulley 261 of a third double floating pulley 263 before terminating at a single floating pulley 265.

As further shown in FIG. 7, a third cable-and-pulley subassembly 210 includes a third cable 274 having a first end coupled to the leg station 204. The third cable 274 is engaged onto eleventh and twelfth guide pulleys 276, 278, and extends upwardly through the first upright member 270 to engage onto a lower pulley 280 of the second double floating pulley 268. The third cable 274 further then engages onto a thirteenth guide pulley 282 and extends outwardly along a first horizontal member 230 of the support frame 209 (FIG. 2). The third cable 274 then engages onto a fourteenth guide pulley 284 that is coupled to the first horizontal member 230 of the support frame 209, and then extends back along the engagement member 228 to attach at a termination point 286 on the bench support assembly 221 (FIG. 2).

Referring again to FIG. 7, in this embodiment, a fourth cable-and-pulley subassembly 267 is operatively associated with the high pull station 232. The fourth cable-and-pulley subassembly 267 includes the fourth cable 269 coupled to a second anchor point 271 proximate an upper end of the second upright member 242. The fourth cable 269 engages onto an upper pulley 273 of the third double floating pulley 263, and onto fifteenth and sixteenth guide pulleys 275, 277 before terminating at the high pull station 232. In this embodiment, a stop 299 is coupled to the fourth cable 269 proximate the high pull station 232. As an exercising force is exerted on the lat bar 233 of the high pull station 232, various portions of the cable-and-pulley assembly 250 are tensioned and cooperate such that a corresponding force is transmitted through the fourth cable 269, the second cable 254, and the first cable 262 to the weight stack 205.

Furthermore, a fifth cable-and-pulley subassembly 279 is associated with the butterfly station 234, and includes a fifth cable 281 engaged onto the single floating pulley 265. The fifth cable 281 is then engaged onto seventeenth and eighteenth guide pulleys 283, 285, and each end of the fifth cable 281 terminates at a swing arm 248 of the butterfly station 234. As an exercising force is exerted on one or both of the swing arms 248 of the butterfly station 234, various portions of the cable-and-pulley assembly 250 are tensioned and cooperate such that a corresponding force is transmitted through the fifth cable 281, the second cable 254, and the first cable 262 to the weight stack 205.

Figure 8:
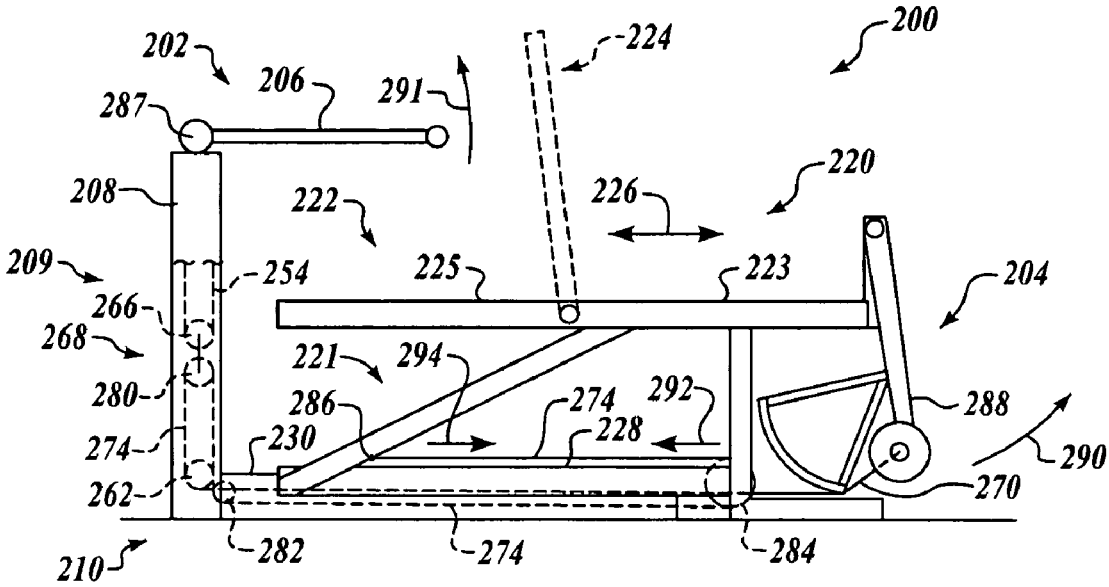
FIG. 8 is a side elevational view of the press station of the exercise machine of FIG. 2.

FIG. 8 is a side elevational view of the press station 202 of the exercise machine 200 of FIG. 2. In this embodiment, the press station 202 is positioned proximate a first end of an adjustable bench 220, and a leg station 204 is positioned at least proximate to (including possibly attached to) a second end of the adjustable bench 220. The press station 202 includes a press arm 206 pivotally coupled to a first upright member 208 of a support frame 209. The press arm 206 includes a transfer member 287 that extends laterally from approximately the press station 202 to approximately the shroud 207. A press arm adjustment assembly 300 is coupled to the press arm 206 and includes a swing plate 302 coupled to the transfer member 287. The eighth pulley 253 of the second cable-and-pulley subassembly 252 is coupled to the swing plate 302.

Figure 9:
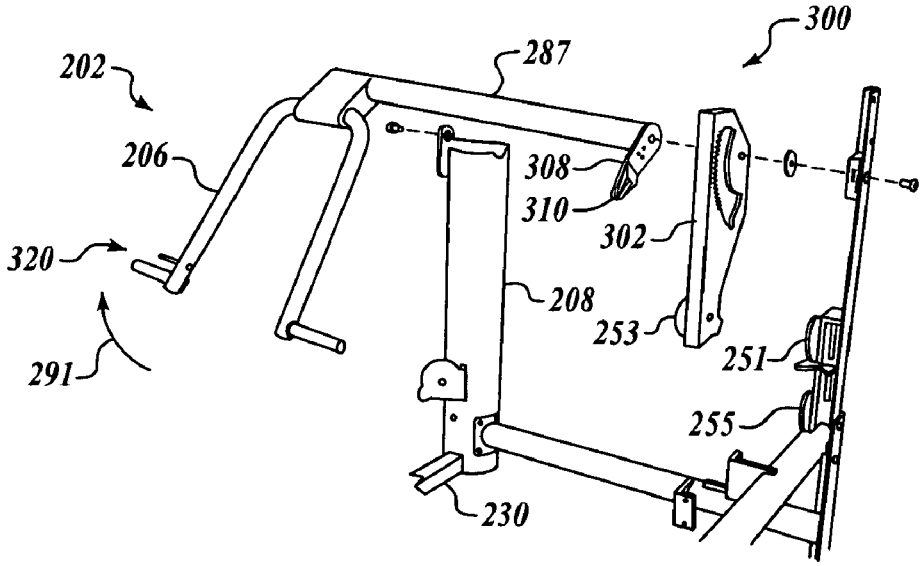
FIGS. 9 and 10 are isometric views of the press station of the exercise machine of FIG. 2.
Figure 10:
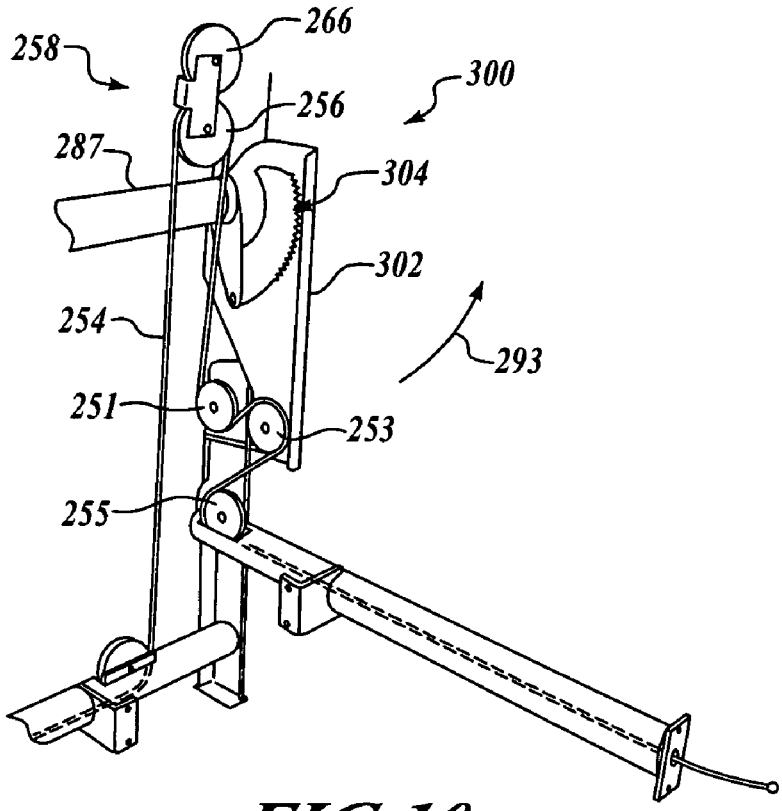

As best shown in FIGS. 9 and 10, the press arm adjustment assembly 300 includes an indexing portion 304 formed in (or coupled to) the swing plate 302, and having a plurality of teeth 306. A bracket 308 is coupled to the transfer member 287 and rotates therewith. A locking member 310 is moveably coupled to the bracket 308, and selectively engages with the teeth 306 of the indexing portion 304, allowing the position of the press arm 206 to be selectively adjusted by the user, as described more fully in co-pending, commonly-owned U.S. patent application Ser. No. 10/913,132 filed concurrently herewith under, which application is incorporated herein by reference.

In operation, the press arm 206 may then be freely rotated upwardly or downwardly so that the press arm 206 may be moved into a desired initial position. After the press arm 206 is moved into the desired position, the user may engage the locking member 310, securing the press arm 206 to the swing plate 302. The user may then exert a lifting force on the press arm 206 to cause the press arm 206 to rotate upwardly along an arc 291 (FIG. 9). In turn, the transfer member 287 is rotated and causes the swing plate 302, and thus the eighth pulley 253, to move along an arc 293 (FIG. 10). The seventh and ninth pulleys 251, 255 remain fixed in position relative to the eighth pulley 253 during the movement of the swing plate 302. Various portions of the cable-and-pulley assembly 250 are then tensioned and cooperate such that a corresponding force is transmitted through the second cable 254 and the first cable 262 to the weight stack 205 which provides the desired load for the exercise.

Referring again to FIG. 8, in this embodiment, an adjustable bench 220 is positioned proximate the press station 202 and the leg station 204. The adjustable bench 220 includes a bench support assembly 221 having a first portion 223 and a second portion 225 coupled thereto. An engagement member 228 of the support assembly 221 is adapted to slideably engage the first horizontal member 230 of the support frame 209. A user may pivot the second portion 225 into a first position 222 that supports the user in a supine or prone position, or into a second position 224 that supports the user in a sitting position. If a user desires to move the adjustable bench 220 along a lengthwise axis 226 (FIG. 8), the user may simply push or pull the adjustable bench 220 in the desired direction until the desired position is achieved. The third cable 274 is operatively coupled between the leg station 204 and the termination point 286 on the bench support assembly 221 so that as the adjustable bench 220 is repositioned, the engagement member 228 slides over the first horizontal member 230 and the third cable 274 is simply drawn over the pulleys 276-284 of the third cable-and-pulley subassembly 210. Further aspects of the adjustable bench 220 are described more fully in co-pending, commonly owned U.S. patent application Ser. No. 10/913,136 filed concurrently herewith under, now issued as U.S. Pat. No. 7,303,514, which application is incorporated herein by reference.

In operation, as the user exerts a force on a swing arm 288 of the leg station 204 to cause the swing arm 288 to swing upwardly along an arc 290 (FIG. 8), one or more of the various cable-and-pulley subassemblies of the cable-and-pulley assembly 250 are tensioned and cooperate such that a corresponding force is transmitted through the third cable 254, the second cable 254, and the first cable 262 to the weight stack 205.

Although the exercise machine 200 is described above and shown in the accompanying figures as having a weight stack 205, it will be appreciated that in alternate embodiments, a wide variety of devices may be used to provide the desired training load. For example, in alternate embodiments, the weight stack 205 may be replaced with a single weight, or with one or more hydraulic or pneumatic resistance devices, springs, stretchable bands, flexible rods, resilient members, bendable members, or any other suitable type of training load.

It will also be appreciated that, in alternate embodiments, it is not necessary that cable-and-pulley assemblies (and subassemblies) be used. A variety of known force-transmitting mechanisms may be used instead of cable-and-pulley assemblies, including, for example, belts, chains, levers, linkages, direct drives, hydraulic systems, and other suitable force-transmitting assemblies.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An exercise machine, comprising:

a load;

a force-transferring assembly operatively coupled to the load, the force-transferring assembly including at least one pulley;

a support frame operatively coupled to the force-transferring assembly and including an upright member and a support member projecting outwardly from the upright member, the support member having a proximal end portion that is proximate the upright member and a distal end portion that is distal from the upright member, at least part of the force-transferring assembly being coupled to the support member at a location distally-spaced from the upright member; and an exercise station coupled to the force-transferring assembly proximate the support member of the support frame, wherein the support member is operatively coupled to the upright member of the support frame by an adjustment assembly, the adjustment assembly being configured to maintain the support member in a fixed position during use of the exercise station, and being adjustable to enable the support member to project from the upright member at a plurality of support positions such that the exercise station is correspondingly adjustable over a plurality of vertical positions when the exercise station is not in use, and wherein the adjustment assembly includes:

a pivot member at least partially disposed through a first portion of the support member between the proximal and distal end portions and at least partially disposed through the upright member, the pivot member pivotably coupling the outwardly-projecting support member to the upright member and rotatably supporting the at least one pulley of the force-transferring assembly; and a threaded member at least partially disposed through the support member at a location spaced apart from the pivot member toward the proximal end portion of the support member, the threaded member being threadedly engaged through a threaded portion coupled to the upright member, the threaded member being configured such that when rotated in a first direction the support member is pivoted in a first pivot direction and the exercise station is raised, and when rotated in a second direction the support member is pivoted in a second pivot direction and the exercise station is lowered.

2. The exercise machine of claim 1, wherein the upright member comprises a substantially hollow portion, the adjustment assembly and the at least one pulley being substantially enclosed within the substantially hollow portion.

3. The exercise machine of claim 1, wherein the force-transferring assembly comprises a cable-and-pulley assembly having at least one cable coupled to the exercise station.

4. The exercise machine of claim 1, wherein the force-transferring assembly includes a first cable coupled to the load and a second cable operatively coupled to the first cable by a double floating pulley, and wherein the exercise station is coupled to the second cable.

5. The exercise machine of claim 2, wherein the at least one pulley comprises a first pulley and a second pulley, the first pulley being rotatably supported by the pivot member and substantially enclosed within the substantially hollow portion of the upright member, the second pulley being rotatably coupled to the support member proximate the distal end portion of the support member, and wherein the force-transferring assembly includes a cable operatively engaged with the first and second pulleys and coupled to the exercise station proximate the distal end portion of the support member.

6. The exercise machine of claim 1, wherein the at least part of the force-transferring assembly coupled to the support member at a location distally-spaced from the upright member includes a pulley coupled to a distal portion of the support member, and a cable operatively engaged with the pulley.

7. The exercise machine of claim 1, wherein the exercise station comprises a high pull station.

8. The exercise machine of claim 1, wherein the force-transferring assembly includes a guide pulley, the guide pulley being coupled to the support member of the support frame.

9. An exercise machine, comprising:

a load;

a force-transferring assembly operatively coupled to the load, the force-transferring assembly including at least one pulley;

a support frame operatively coupled to the force-transferring assembly and having a support member pivotably coupled to an upright member by an adjustment assembly, the support member projecting outwardly from the upright member and having a proximal end portion that is proximate the upright member and a distal end portion that is distal from the upright member, at least part of the force-transferring assembly being coupled to the support member at a location distally-spaced from the upright member; and an exercise station coupled to the force-transferring assembly proximate the support member, wherein the adjustment assembly is configured to maintain the support member in a fixed position during use of the exercise station, and to enable adjustment of a projection angle of the support member relative to the upright member when the exercise station is not in use such that the exercise station is correspondingly adjustable over a plurality of vertical positions, and wherein the adjustment assembly includes:

a pivot member at least partially disposed through a first portion of the support member between the proximal and distal end portions and at least partially disposed through the upright member, the pivot member pivotably coupling the outwardly-projecting support member to the upright member and rotatably supporting the at least one pulley of the force-transferring assembly; and a threaded member at least partially disposed through the support member at a location spaced apart from the pivot member toward the proximal end portion of the support member, the threaded member being threadedly engaged through a threaded portion coupled to the upright member, the threaded member being configured such that when rotated in a first direction the support member is pivoted in a first pivot direction and the exercise station is raised, and when rotated in a second direction the support member is pivoted in a second pivot direction and the exercise station is lowered.

10. The exercise machine of claim 9, wherein the force-transferring assembly includes a first cable coupled to the load and a second cable operatively coupled to the first cable by a double floating pulley, and wherein the exercise station is coupled to the second cable.

11. The exercise machine of claim 9, wherein the force-transferring assembly includes a guide pulley coupled to the support member and a cable engaged onto the guide pulley, and wherein the exercise station is coupled to the cable.

12. The exercise machine of claim 9, wherein the upright member comprises a substantially hollow portion, the adjustment assembly and the at least one pulley being substantially enclosed within the substantially hollow portion.

13. The exercise machine of claim 9, wherein the at least part of the force-transferring assembly coupled to the support member at a location distally-spaced from the upright member includes a pulley coupled to a distal portion of the support member, and a cable operatively engaged with the pulley.

14. The exercise machine of claim 12, wherein the at least one pulley comprises a first pulley and a second pulley, the first pulley being rotatably supported by the pivot member and substantially enclosed within the substantially hollow portion of the upright member, the second pulley being rotatably coupled to the support member proximate the distal end portion of the support member, and wherein the force-transferring assembly includes a cable operatively engaged with the first and second pulleys and coupled to the exercise station proximate the distal end portion of the support member.

15. A method of exercising using an exercise machine, comprising:

providing an exercise station operatively coupled by a force-transferring assembly to a load, the force-transferring assembly including at least one pulley, the exercise station being positioned proximate a support member coupled to an upright member of a support frame by an adjustment assembly configured to maintain the support member in a fixed position during use of the exercise station, and to enable adjustment of a position of the support member relative to the upright member such that the exercise station is correspondingly adjustable over a plurality of vertical positions when the exercise station is not in use, the support member having a proximal end portion that is proximate the upright member and a distal end portion that is distal from the upright member, at least part of the force-transferring assembly being coupled to the support member at a location distally-spaced from the upright member, and wherein the adjustment assembly includes:

a pivot member at least partially disposed through a first portion of the support member between the proximal and distal end portions and at least partially disposed through the upright member, the pivot member pivotably coupling the outwardly-projecting support member to the upright member and rotatably supporting the at least one pulley of the force-transferring assembly; and a threaded member at least partially disposed through the support member at a location spaced apart from the pivot member toward the proximal end portion of the support member, the threaded member being threadedly engaged through a threaded portion coupled to the upright member;

with the exercise station not in use, varying a vertical height of the exercise station by adjusting the support member with respect to the upright member using the adjustment assembly, including at least one of rotating the threaded member in a first direction to raise the exercise station, or rotating the threaded member in a second direction to lower the exercise station;

maintaining the support member in a fixed position using the adjustment assembly; and with the support member maintained in the fixed position by the adjustment assembly, exerting an exercising force on the exercise station.

16. The method of claim 15, wherein varying a vertical height of the exercise station by adjusting the support member with respect to the upright member includes varying a vertical height of the exercise station by pivoting the support member with respect to the upright member.

17. The method of claim 15, wherein providing an exercise station operatively coupled by a force-transferring assembly to a load includes:

providing an exercise station operatively coupled by a force-transferring assembly having a pulley coupled to a distal portion of the support member, and a cable operatively engaged with the pulley and extending between the exercise station and the load.

* * * * *